United States Patent [19]

Stadelhofer et al.

[11] 4,427,526

[45] Jan. 24, 1984

[54] PROCESS FOR THE PRODUCTION OF HYDROGENATED AROMATIC COMPOUNDS AND THEIR USE

[75] Inventors: Jürgen Stadelhofer, Dortmund; Heinz-Gerhard Franck, Bad Soden-Neuenhain; Helmut Köhler, Mülheim, all of Fed. Rep. of Germany

[73] Assignee: Rütgerswerke Aktiengesellschaft, Frankfurt am Main, Fed. Rep. of Germany

[21] Appl. No.: 321,836

[22] Filed: Nov. 16, 1981

[30] Foreign Application Priority Data

Dec. 5, 1980 [DE] Fed. Rep. of Germany ..... 3045847

[51] Int. Cl.[3] ..... C10G 1/00; C10G 45/00

[52] U.S. Cl. ..... 208/8 LE; 208/56; 208/142; 585/252; 585/266

[58] Field of Search ..... 208/8 LE, 142, 56; 585/252, 266

[56] References Cited

U.S. PATENT DOCUMENTS

| | | | |
|---|---|---|---|
| 2,438,148 | 3/1948 | Corson et al. | 585/252 X |
| 4,003,820 | 1/1977 | Pelofsky et al. | 208/142 X |
| 4,012,311 | 3/1977 | Greene | 208/142 X |
| 4,101,416 | 7/1978 | Dolbear | 585/266 X |
| 4,189,372 | 2/1980 | Baldwin et al. | 208/8 LE |
| 4,294,686 | 10/1981 | Fisher et al. | 208/56 |

FOREIGN PATENT DOCUMENTS

| | | | |
|---|---|---|---|
| 760546 | 8/1956 | United Kingdom | 208/56 |
| 1481958 | 8/1977 | United Kingdom | 208/8 LE |

*Primary Examiner*—William G. Wright

*Attorney, Agent, or Firm*—Beveridge, DeGrandi & Kline

[57] ABSTRACT

A process is disclosed for the production of hydrogenated aromatic compounds and mixtures thereof by thermal treatment of aromatic oils or mixtures, derived from coal or petroleum, wherein the improvement over the prior art resides in thermally treating aromatic oils of boiling range 280°–450° C., with residues from the processing of liquid coal conversion products and/or petroleum refining, for up to 10 hours in a temperature region between 200° and 380° C. and at a pressure of maximum 15 bar, with good inter-mixing of the reaction components, and thereafter separating the products by distillation from the pitch-like residue.

8 Claims, No Drawings

PROCESS FOR THE PRODUCTION OF HYDROGENATED AROMATIC COMPOUNDS AND THEIR USE

The invention relates to a process for the production of hydrogenated aromatic compounds or mixtures of aromatic compounds by thermal treatment of aromatic oils, and their mixtures, derived from coal or petroleum.

Because of the long-term increasing scarcity of petroleum, the coal which is plentiful in many industrial nations assumes increasing importance as a raw material. Coal conversion, in particular for the recovery of liquid products, is therefore being pushed ahead at present at great expense. A main target direction of these efforts consists of the reaction of coal with suitable hydrocarbon solvents. The solvents should have available as high as possible a proportion of transferable hydrogen. If they cannot provide sufficient hydrogen, the coal is hydrogenated with the use of molecular hydrogen.

An example of the first direction of work is the Exxon donor process, in which a partially hydrogenated aromatic oil is reacted with coal at high pressure and at temperatures of about 420° C. Examples of the second route are provided by the SRC-II process and the H-Coal process (H.-G. Franck, H. Knop, Kohleveredlung, Springer-Verlag, 1979, p. 242–244).

In each case direct or indirect hydrogen transfer is necessary to obtain a high coal conversion, since the optimum degree of digestion of the coal is not reached with unhydrogenated hydrocarbon mixtures, as reported by Davies et al. (Journal of the Inst. of Fuel, September 1977, 121). In order to circumvent the costly direct hydrogenation of coal, the hydrogen is transferred to hydrocarbon mixtures, in particular to mixtures of armoatics of boiling range 200°–450° C., in many processes (e.g., Exxon Donor process, Pott-Broche extraction). The hydrogenation is here usually carried out under pressures of up to 280 bar and with the use of suitable catalysts (see, e.g., D.C. Cronauer et al., Ind. Eng. Proc. Des. Dev. 17, 1978, 281 or U.S. Pat. No. 2,438,148).

The costs of the expensive hydrogen must be taken into account for this process, as well as the technical disadvantage of the high pressures.

The object of this invention is to develop a process according to which the transfer of hydrogen to mixtures of aromatics, as required for liquefaction of coal, is technically simple with mild pressure conditions and is possible without the use of molecular hydrogen.

This problem is solved by a process which is characterized in that aromatic oils of boiling range of 280°–450° C., with residues from the processing of liquid coal conversion products and/or from petroleum refining are thermally treated in a temperature range between 200° and 380° C. at a maximum pressure of 15 bar, with good intermixing of the reaction components, for up to 10 hours, and then separated by distillation from the pitch-like residue.

Without here setting up a theoretical model, it can be assumed that in such a reaction scheme the hydrogen liberated in polymerization of the residues of the tar distillation and petroleum processing reacts with the aromatics to form hydroaromatics under the mild conditions according to the invention.

The formation of 9,10-dihydroanthracene from anthracene with a petroleum pitch which is not more closely specified has already been described (H. Marsh et al, Carbon Conference 1980, Baden-Baden, Preprints, p. 377).

The purpose of this reaction of pitch with anthracene was however primarily not the production of hydroanthracenes but the testing of the suitability of pitch as a coking coal improvement medium.

Hence a temperature of 400° C. was used in this model investigation. However, this temperature is unfavorably far above the reaction threshold for the thermal polymerization of aromatic oils, which polymerise strongly in this temperature region and thus cannot be recovered in the hydrogenated form.

In the present invention, on the other hand, a wide spectrum of aromatics is converted into partially hydrogenated aromatics by treatment with various distillation residues and refining residues at a temperature at which a polymerisation of the aromatic oils can be substantially excluded, so that complete recovery of the aromatics in hydrogenated form is possible.

Particularly noteworthy as an example of the aromatics mixtures to be used according to the invention are fractions from the distillative processing of coal tars of hydrocarbons from the distillative processing of pyrolysis oils which arise in the steam cracking of petroleum fractions. Fractions with a boiling range between 280° and 450° C. and found to be the most suitable for the process according to the invention.

According to the invention, by the expression "residues from the processing of liquid coal conversion products and petroleum refining" is to be understood, in particular, coal tar pitch or residues from the pressure gasification of coal as well as distillation residues of petroleum origin and from thermal or catalytic cracking of petroleum fractions.

The research on which the invention is based surprisingly shows that hydrogenation of the aromatics already takes place at relatively low temperatures and hence can be operated at extraordinarily low pressures.

In particular, the fact is surprising that even anthracene poor fractions, such as "filtered anthracene oil" (see H.-G. Franck, G. Collin, Steinkohlenteer, Springer-Verlag 1968, p. 57), can be hydrogenated, so that the technical recovery of anthracene for the important dyestuff starting material, anthracene, is not affected with a large-scale utilization of the process according to the invention.

The process according to the invention is described in Examples 1–3.

The uptake of hydrogen was followed by the nuclear magnetic resonance spectroscopically determined ratio of aromatic to aliphatic protons of the fractions before and after the thermal treatment.

This method of analysis is particularly suitable for the investigation of hydrogenation processes and the statistical structure analysis of hydrocarbons (see, e.g., K.D. Bartle, Rev. Pure Appl. Chem., 22, 1972, 79).

EXAMPLE 1

100 parts/wt. of coal tar pitch of softening point of 70° C. (K.S.) from the processing of high temperature tar (see, e.g., H.-G. Franck, G. Collin, Steinkohlenteer, Springer-Verlag, Berlin 1968, p. 29 ff.) were treated with 200 parts/wt. crude anthracene oil (boiling range 300°–400° C.) in an autoclave at 340° C. and for a reaction time of 5 hr. The maximum working pressure was 3 bar.

The reaction product was then split by distillation into 199 parts/wt. of anthracene oil and 99 parts/wt. pitch. The increased fraction of hydroaromatics is shown by the data given in the Table.

EXAMPLE 2

Procedure was as in Example 1. Instead of the coal tar pitch, a distillation residue with a softening point of 80° C. (K.-S.) (100 parts/wt.) from the processing of pyrolysis oil from crude gasoline cracking was used. Crude anthracene oil (200 parts/wt.), as in Example 1, was again used. The operating temperature was 350° C.; the reaction time was 2 hr. The maximum pressure was 3 bar. Processing was as in Example 1. There were obtained 198 parts of hydrogenated anthracene oil and 100 parts of pitch residue.

The increased hydroaromatics content is shown by the data given in the Table.

EXAMPLE 3

Procedure was as in Example 1. 50 parts/wt. of distillation residues from the processing of pyrolysis oil were reacted with 200 parts/wt. of filtered anthracene oil (boiling range 300–400° C.) at 360° C. and for 3 hr reaction time, using a maximum pressure of 3 bar. The reaction product was separated into 50 parts/wt. pitch and 198 parts/wt. anthracene oil fraction. 70 parts of the thus obtained hydrogenated anthracene oil were mixed with 30 parts of milled high-volatile coal ("Westerholt"). The suspension was thermally treated at 355° C. and a pressure of 15 bar for 2 hours, in order to disintegrate the coal. A homogeneous, pitch-like product was obtained in 96% yield.

The increased hydroaromatics content is shown by the data given in the Table.

The hydrogenated aromatics or aromatics mixtures obtained according to the invention can be used in an excellent manner for the disintegration of coal under known conditions.

TABLE

Reaction Components and Product Characterization for the Production of Hydrogenated Aromatics

| Materials Used: | Reaction Conditions (Temp., Time) | | Fraction of Aliphatic Protons (%) | Yield (%) |
|---|---|---|---|---|
| Example 1 | | | | |
| Coal tar pitch, Crude anthracene oil | 340° C. | 5 hr | | |
| Hydrogenated anthracene oil | | | 16.0 | 99 |
| Example 2 | | | | |
| Pyrolysis pitch, Crude anthracene oil | 350° C. | 2 hr | | |
| Hydrogenated anthracene oil | | | 19.0 | 99 |
| Example 3 | | | | |
| Pyrolysis pitch, Filtered anthracene oil | 360° C. | 3 hr | | |
| Filtered anthracene oil, hydrogenated | | | 25,0 | 99 |
| Comparative Example | | | | |
| Crude anthracene oil | — | — | 14.0 | — |
| Filtered anthracene oil | — | — | 20.0 | — |

We claim:

1. In a process for the production of a hydrogenated aromatic compound or mixture of aromatic compounds by thermal treatment of an aromatic oil or mixture of aromatic oils, derived from coal or petroleum, the improvement comprising:

forming an admixture of aromatic oils having a boiling range of 280°–450° C., with residues from the processing of liquid coal conversion products and/or petroleum refining, and thermally treating said admixture at a temperature in the range of 200° to 380° C. and at a pressure up to a maximum of 15 bar, and up to 10 hours with good inter-mixing of the reaction components, to thereby obtain hydrogenated aromatic compounds and thereafter separating the hydrogenated aromatic compounds by distillation from the pitch-like residue.

2. The process according to claim 1, wherein a fraction boiling between 280° and 450° C. of a coal tar is used as the coal derived aromatic oil.

3. The process according to claim 1, wherein the fraction boiling between 280° and 450° C. of a coal tar is a filtered anthracene oil.

4. The process according to claim 1, wherein a fraction boiling between 280° and 450° C. of a pyrolysis oil obtained in the steam cracking of petroleum fractions is used as the aromatic oil derived from petroleum.

5. The process according to claims 1, 2 or 3, wherein coal tar pitch and/or residues from the pressure gasification of coal are used as the residue from the processing of liquid coal conversion products.

6. The process according to claims 1, 2 or 3, wherein residues from the distillation of crude oil and also from the thermal or catalytic cracking of petroleum fractions are used, alone or mixed together, as the residues from petroleum refining.

7. A hydrogenated aromatic oil produced according to the process of claims 1, 2 or 3.

8. A process for the disintegration of coal which comprises treating coal with hydrogenated aromatic compounds or mixtures of aromatic compounds obtained by thermal treatment of aromatic oils or their mixtures, derived from coal or petroleum, as defined in claims 1, 2 or 3, wherein aromatic oils of boiling range 280°–450° C., with residues from the processing of liquid coal conversion products and/or petroleum refining, are thermally treated for up to 10 hours in a temperature region between 200° and 380° C. and at a pressure of maximum 15 bar, with good inter-mixing of the reaction components, and thereafter are separated by distillation from the pitch-like residue.

* * * * *